US007901255B2

(12) United States Patent
Neumetzler et al.

(10) Patent No.: US 7,901,255 B2
(45) Date of Patent: Mar. 8, 2011

(54) OVERVOLTAGE PROTECTION MAGAZINE

(75) Inventors: Heiko Neumetzler, Berlin (DE); Joachim Stark, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/526,923

(22) PCT Filed: Feb. 13, 2007

(86) PCT No.: PCT/EP2007/010937
§ 371 (c)(1),
(2), (4) Date: Aug. 12, 2009

(87) PCT Pub. No.: WO2008/098607
PCT Pub. Date: Aug. 21, 2008

(65) Prior Publication Data

US 2010/0112872 A1 May 6, 2010

(30) Foreign Application Priority Data

Feb. 12, 2007 (DE) ..... 10 2007 006 693

(51) Int. Cl.
*H01R 9/22* (2006.01)

(52) U.S. Cl. ..... 439/709

(58) Field of Classification Search ..... 439/620.08, 439/709, 108; 361/118, 119
See application file for complete search history.

(56) References Cited

U.S. PATENT DOCUMENTS

| | | | | |
|---|---|---|---|---|
| 4,345,294 | A * | 8/1982 | Forberg et al. | 361/119 |
| 4,504,883 | A | 3/1985 | Uchida et al. | |
| 4,617,602 | A | 10/1986 | Dolansky et al. | |
| 4,647,121 | A * | 3/1987 | Dolansky et al. | 439/108 |
| 5,923,238 | A | 7/1999 | Polzehl et al. | |
| 6,198,615 | B1 | 3/2001 | Pelosi et al. | |
| 6,556,411 | B1 * | 4/2003 | Hoeft et al. | 361/119 |
| 6,654,223 | B1 * | 11/2003 | Bippus et al. | 361/118 |
| 6,821,153 | B2 * | 11/2004 | Otto et al. | 439/620.08 |
| 7,722,403 | B2 * | 5/2010 | Neumetzler | 439/620.08 |
| 2007/0064373 | A1 * | 3/2007 | Neumetzler et al. | 361/119 |
| 2009/0011633 | A1 | 1/2009 | Busse et al. | |
| 2010/0173516 | A1 * | 7/2010 | Neumetzler et al. | 439/404 |

FOREIGN PATENT DOCUMENTS

| | | |
|---|---|---|
| DE | 34 12 452 | 10/1985 |
| DE | 197 21 947 | 11/1998 |
| DE | 103 17 621 | 11/2004 |
| DE | 10 2004 017 605 | 10/2005 |

* cited by examiner

*Primary Examiner* — Alexander Gilman
(74) *Attorney, Agent, or Firm* — Merchant & Gould P.C.

(57) ABSTRACT

An overvoltage protection magazine includes a plastic housing, electric contacts, overvoltage protection elements, and at least one contact edge. The electric contacts are disposed in the plastic housing and have an insertion region and a contact region. The electric contacts are disposed in a row in the insertion region. The plastic housing has receptacles for the overvoltage protection elements, which are disposed on both sides (e.g., Left and Right) along the longitudinal direction. The contact regions of the electric contacts protrude into the respective receptacles and establish a first electric contact to the respective overvoltage protection element. The contact edge has spring contact elements in the region of the receptacles, which establish the second contact to the overvoltage protection element.

14 Claims, 5 Drawing Sheets

OVERVOLTAGE PROTECTION MAGAZINE

This application is a National Stage Application of PCT/EP2007/010937, filed 13 Dec. 2007, which claims benefit of Serial No. 10 2007 006 693.9, filed 12 Feb. 2007 in Germany and which applications are incorporated herein by reference. To the extent appropriate, a claim of priority is made to each of the above disclosed applications.

BACKGROUND

The invention relates to an overvoltage protection magazine for insertion into a terminal block for telecommunications and data technology.

An overvoltage protection magazine such as this is known, for example, from DE 103 17 621 A1.

DE 10 2004 017 605 B3 discloses a plug connector for printed circuitboards, having a number of contact elements, with the contact elements each having two connection sides, with one connection side being in the form of an insulation-displacement contact for connection of cores, and with the other connection side being in the form of a fork contact for making contact with connecting pads on a printed circuitboard. The contact element is in this case formed in two parts, with a first part of the contact element comprising the insulation-displacement contact and the second part comprising the fork contact, with one contact limb being arranged on each of the two parts of the contact element, and with the two contact limbs forming an isolating contact. An overvoltage protection magazine can then be inserted into a row of isolating contacts such as these.

SUMMARY

The invention is based on the technical problem of providing an overvoltage protection magazine of compact design.

For this purpose, the overvoltage protection magazine has a plastic housing, electrical contacts, overvoltage protection elements and at least one contact comb, with the electrical contacts being arranged in the plastic housing and each having an insertion area and a contact area, with the electrical contacts being arranged in a row in the insertion area, with the plastic housing having holders for the overvoltage protection elements which are arranged on both sides (left, right) along the longitudinal direction, with the contact areas of the electrical contacts projecting into the respective holder and producing a first electrical contact with the respective overvoltage protection element, and with the contact comb having sprung contact elements in the area of the holders, which produce the second contact with the overvoltage protection element. Since no overvoltage protection elements are arranged one above the other, the height of the overvoltage protection magazine is very small, with the two rows which are located alongside one another at the same time resulting in a high packing density. The actual fixing is provided mainly by the sprung elements of the contact comb from the outside, so that the plastic body need not absorb much force. Furthermore, this simplifies the configuration of the electrical contacts, since these need be only in the form of a rigid mating contact in the holder, for example in the form of a metal strip which is supported against the inner rear wall of the holder. The overvoltage protection elements are preferably in the form of two-pole gas surge arresters. The overvoltage protection element is preferably cylindrical, with the bottom surfaces having the contacts, that is to say with the bottom surface of the overvoltage protection element being pressed against the contact area of the electrical contact in the holder.

The electrical contacts are preferably composed of metal, with the adjacent electrical contacts preferably being bent differently since they are arranged in a row in the insertion area, but with their contact area being passed alternately into the left-hand and right-hand holder. This embodiment has the advantage that it avoids contact crossings.

In one preferred embodiment, the contact comb is U-shaped and has sprung contact elements on each of its limbs. This has the advantage of balanced force distribution.

In a further preferred embodiment, the holders for the overvoltage protection elements are arranged offset with respect to one another on the two sides. On the one hand, this has the advantage that the electrical contacts can be guided more easily. A further advantage is more robustness.

In a further preferred embodiment, the sprung contact elements of the contact comb are in the form of cuts. For embodiments where the holders are arranged offset with respect to one another, the cuts are also offset from the two limbs, thus making the contact comb more robust.

In a further preferred embodiment, a ground contact is arranged at least one end of the contact comb, via which the overvoltage protection elements can be connected to ground or frame.

In a further preferred embodiment, the ground contact is in the form of a double fork contact or has two fork contacts. On the one hand, this provides a certain amount of redundancy for the ground connection, while on the other hand it increases the current carrying capacity.

In a further preferred embodiment, the electrical contacts are in the form of contact grids, which are stamped free through openings in the plastic housing. This has the advantage that the electrical contacts can also be extrusion coated easily during the production of the plastic housing, so that they are seated firmly in the housing. This is possible because the electrical contacts need not themselves be sprung, and, instead, all of the spring force is applied by the contact comb from the outside. The stamping process then results in the electrical contacts of the contact grid being subsequently electrically isolated from one another.

In a further preferred embodiment, the holders have a circular cross section, so that the preferably cylindrical overvoltage protection elements can be held easily. Furthermore, the holder is preferably open upwards to the upper face, with the opening angle being less than 180°, furthermore preferably being less than 90°. This prevents the overvoltage protection elements from being able to slide out upwards.

In a further preferred embodiment, sliding elements which are formed with an incline are arranged above the holders. This allows the overvoltage protection elements to be fitted from above despite a relatively small opening angle of less than 180°. In this case, these overvoltage protection elements run along the incline, and then drop obliquely into the holder.

In a further preferred embodiment, the edge of the incline projects beyond the overvoltage protection element. This results in the sprung contact elements of the contact comb sliding over the incline while the contact comb is being pushed on, and in the overvoltage protection element touching only the bottom surface. This reduces the risk of damage to the contact metallization on the overvoltage protection element. Furthermore, this improves the assembly reliability, since jamming or tilting of the overvoltage protection element is prevented.

In a further preferred embodiment, the contact comb is formed with at least one locking lug, which is preferably formed by cuts in the same way as the sprung contact elements. Furthermore, the contact comb preferably has two locking lugs, one on each side, but at opposite ends. In this case, by way of example, the locking between the contact comb and the plastic housing can be achieved in the form of a clip which clasps behind it, or a hole-and-pin connection.

In a further preferred embodiment, a hook is arranged above the ground contact and/or the fork contact and latches with the plastic housing, thus preventing the contact comb from being lifted off when the ground contact is pushed onto a ground rail.

One preferred application of the invention is overvoltage protection for a plug connector according to DE 10 2004 017 605 B3.

BRIEF DESCRIPTION OF THE DRAWINGS

The invention will be explained in the following text with reference to one preferred exemplary embodiment. In the figures.

DETAILED DESCRIPTION

Figure 1:
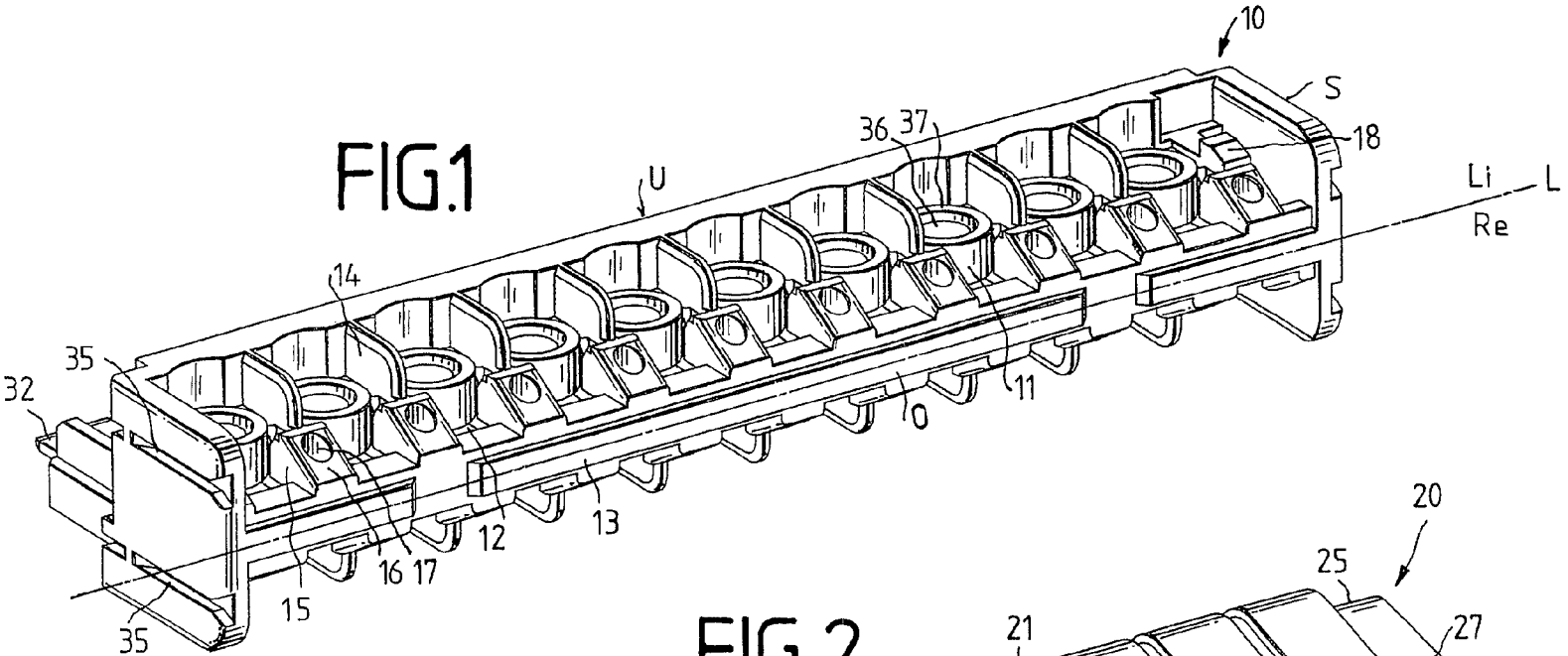
FIG. 1 shows a perspective illustration of a plastic housing with two-pole gas surge arresters inserted in it.
Figure 8:
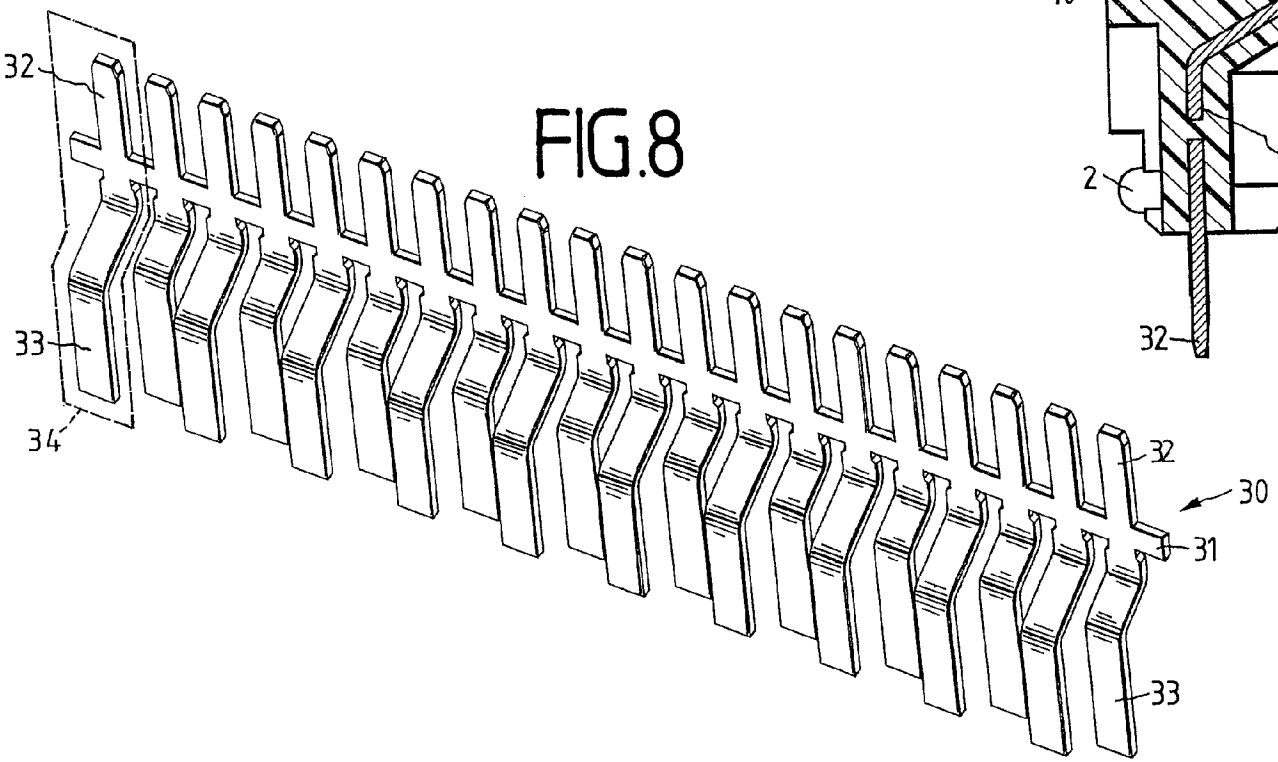
FIG. 8 shows a perspective illustration of the electrical contacts in the form of a contact grid.

FIG. 1 shows a plastic housing 10 with two-pole gas surge arresters 11 inserted in it. The plastic housing 10 has an upper face O, a lower face U and two ends S. Furthermore, the plastic housing 10 has a left-hand face left and a right-hand face right which respectively extend on the left and right from a web 13 which extends in the longitudinal direction L, with the upper face of the web 13 being the same as the upper face O of the plastic body 10. The two-pole gas surge arresters 11 essentially have a cylindrical basic shape, with the contact metallizations being located on the bottom surfaces 36 of the cylinder while, in contrast, the envelope surface is isolated, with the exception of the rim areas 37. The two-pole gas surge arresters 11 are arranged in the holders 12, which are arranged in two rows on the left and right of the web 13 which extends in the longitudinal direction L. The web 13 forms a wall and separates the left-hand and right-hand sides (left, right). The holders 12 have a circular cross section. The individual holders 12 are subdivided by separating walls 14, which are preferably planar. Sliding elements 15 are arranged above the holders 12, and have an incline 16. There is a hole 17 in each of the inclines 16. The actual holder 12 is open at the top to the sliding elements 15, with the opening angle being less than 90°, so that two-pole gas surge arresters 11 cannot slide upwards. For fitting from above, these slide off the incline 16 and drop obliquely, past the separating walls 14, into the holders 12. The holes 17 are dependent on the injection molding, since, when a contact grid 30 is being extrusion-coated, it must be held in position by pins. The holders 12 on the left-hand and right-hand sides (left, right) are each arranged offset with respect to one another, as can be seen particularly well in FIG. 6. One electrical contact 34 is in each case arranged on one wall of the holders 12 and has a contact area 33 which makes contact with the two-pole gas surge arrester 11, as will be explained in more detail in the following text (see FIG. 8). Furthermore, the plastic housing 10 has a latching hook 18 under the last sliding element 15.

The electrical contacts are also injection molded as a contact grid 30 (see FIG. 8) during the production of the plastic housing 10. The contact grid 30 has a number of electrical contacts 34 corresponding to the number of holders 12, and these are initially connected to one another by means of a lateral web 31. Each electrical contact 34 has a straight insertion area 32, which extends as far as the lateral web 31. The insertion areas 31 of all of the electrical contacts 34 are in this case arranged in one row. The electrical contacts are first of all bent somewhat from the lateral web 31 and then merge again into a contact area 33, which is arranged parallel to the insertion area 31. In this case, there is a difference in the bending between adjacent electrical contacts. If the electrical contacts 34 are numbered successively, then all of the even numbers are in each case bent in the same way, and all of the odd numbers are bent in the same way. A plastic wall is then formed between adjacent contacts during extrusion coating with plastic, and separates the holders 12 on the left-hand and right-hand sides, with the contact areas 33 remaining free on one side in the direction of the respective holder 12, where they make contact with the two-pole gas surge arresters 11. After extrusion coating, the lateral web 31 between two electrical contacts is then stamped away. The openings 19 in the plastic housing 10 are used for this purpose.

Figure 2:
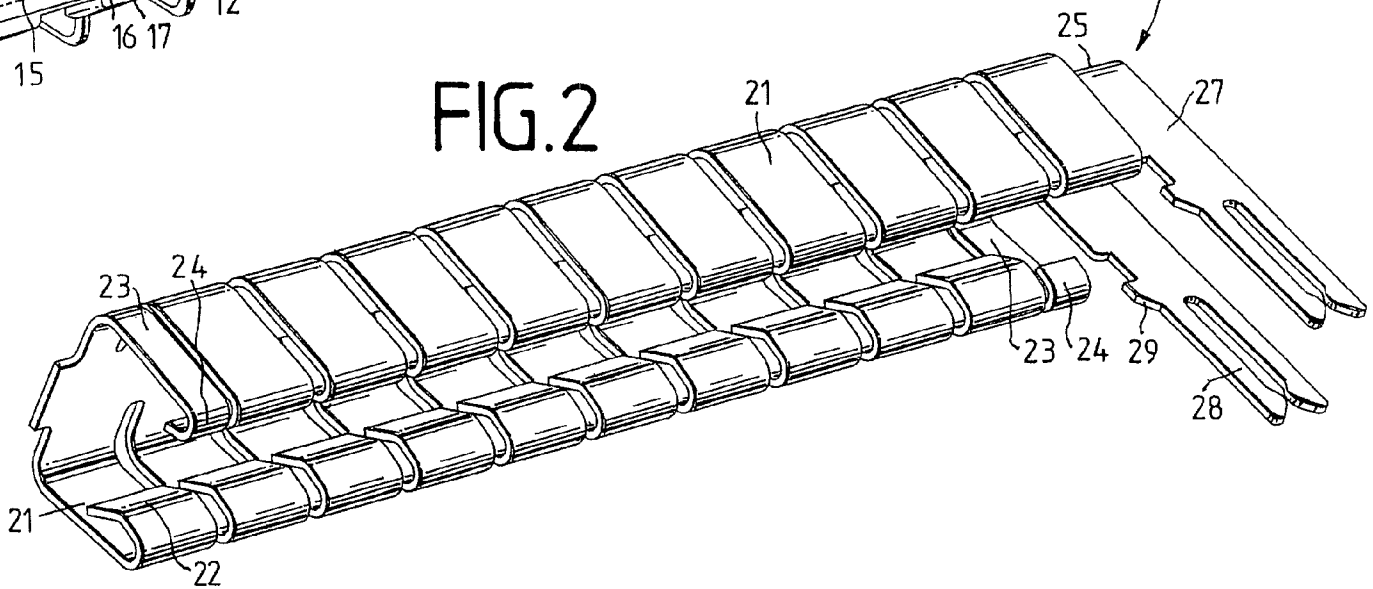
FIG. 2 shows a perspective illustration of a contact comb.

FIG. 2 shows the contact comb 20, which is plugged from above onto the plastic body 10, which is fitted with two-pole gas surge arresters 11. The contact comb 20 is essentially U-shaped, with sprung contact elements 21 being arranged on the two limbs and being formed by cuts from the limbs. In this case, on the lower face, each of the sprung contact elements 21 have a bend 22 which is directed inwards and makes the actual electrical contact with the two-pole gas surge arrester 11 (see also FIG. 7). Furthermore, the contact comb 20 has two locking lugs 23, which also each have a bend 24. The two locking lugs 23 are narrower than the sprung contact elements 21, and interact with the latching hooks 18. A ground contact 25 is arranged at one end of the contact comb 20, and is preferably formed integrally from the contact comb 20. The ground contact 25 is likewise U-shaped, with a fork contact 28 being arranged on each of its two limbs 27. A hook 29 is arranged above each of the fork contacts 28 and locks the contact comb 20 and the plastic housing 10 to one another, so that the contact comb 20 cannot be lifted off when being pushed onto a grounding rail. When the contact comb 20 is being pushed on, the hooks 29 first of all run in grooves 35 at the end S, in order then subsequently to hook on the lower face U.

Figure 3:
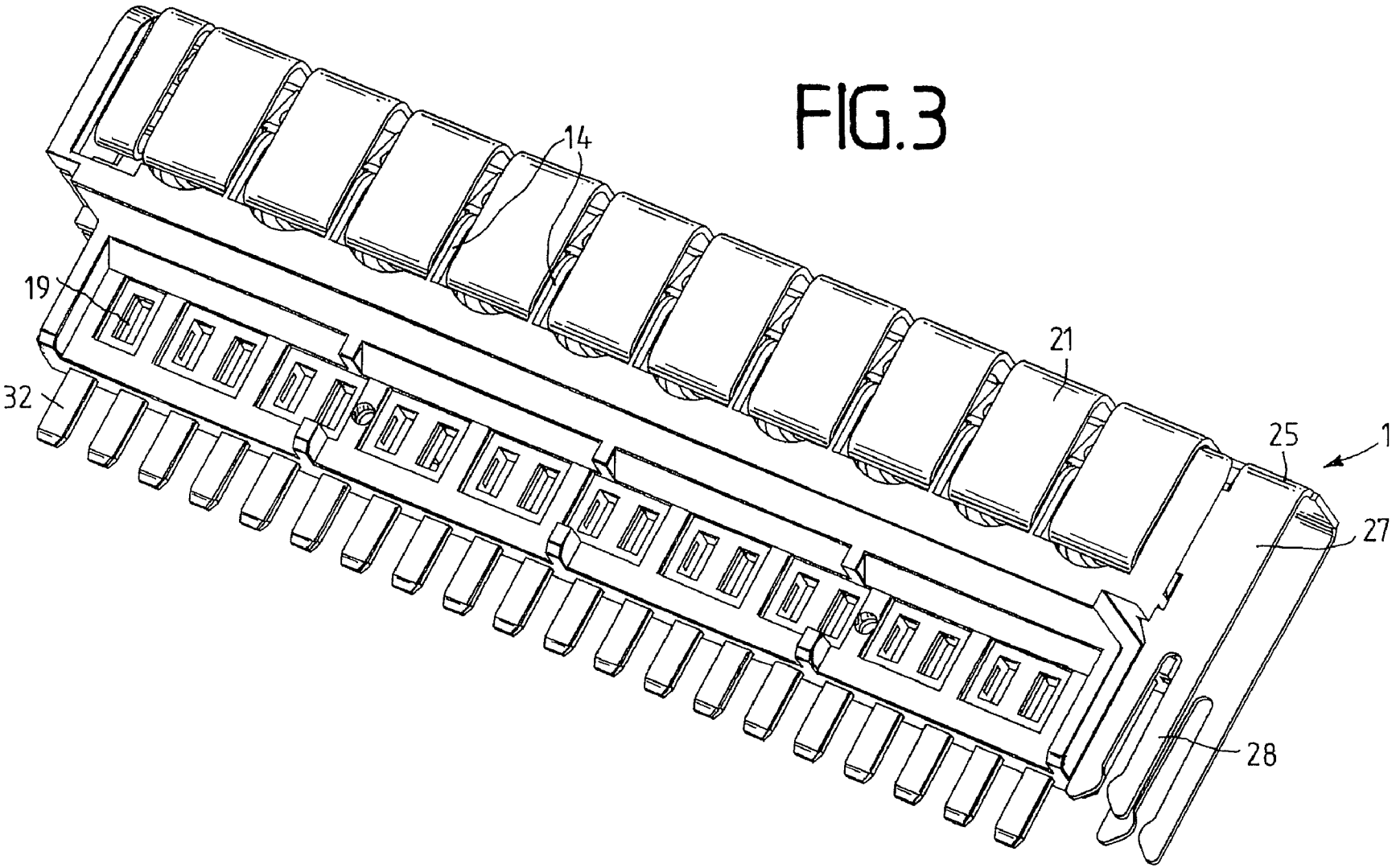
FIG. 3 shows a perspective side view of an overvoltage protection magazine.
Figure 4:
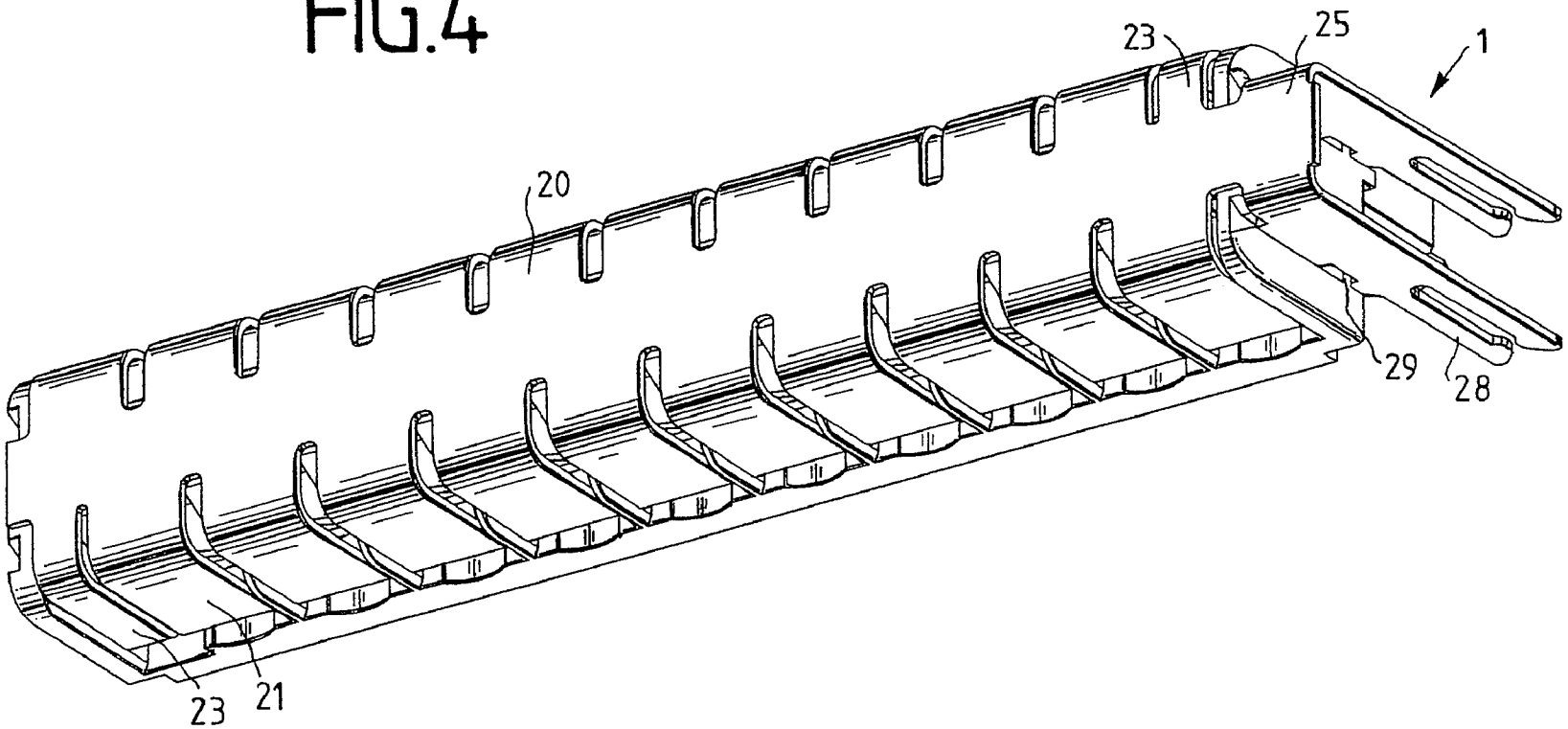
FIG. 4 shows a perspective plan view of the overvoltage protection magazine.
Figure 5:
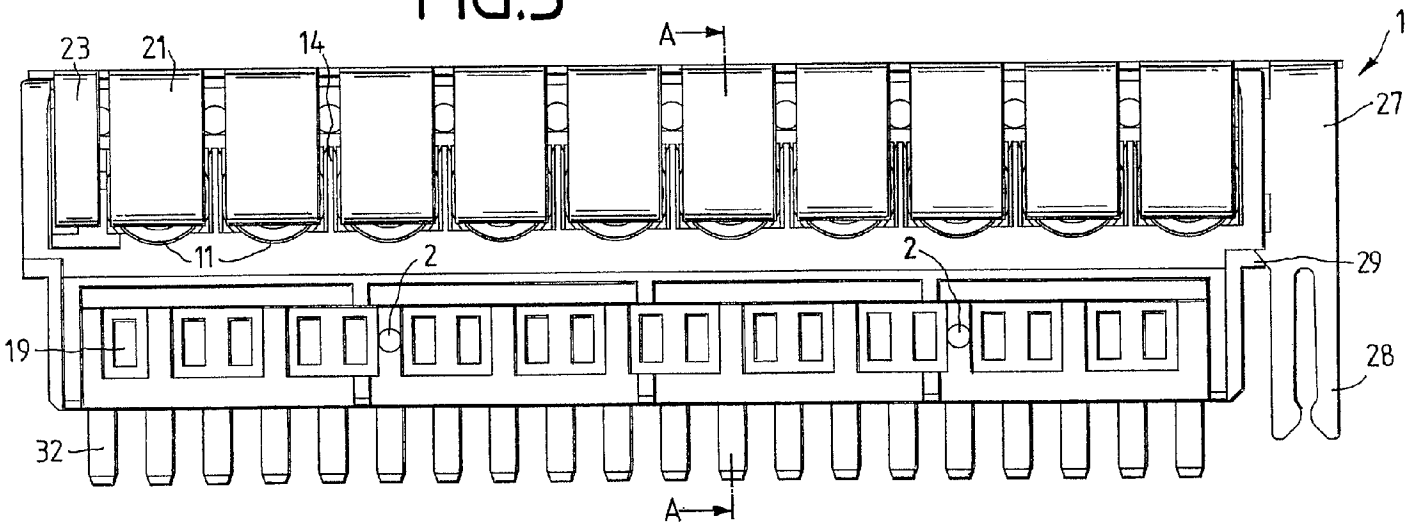
FIG. 5 shows a side view of the overvoltage protection magazine.

The complete overvoltage protection magazine 1 is illustrated in FIGS. 3 to 5, as created after the contact comb 20 has been pushed onto the populated plastic body 10. In this case, FIG. 5 also shows two pins 2, which are used for latching of the overvoltage protection magazine 1 to the terminal block or plug connector for telecommunications and data technology.

Figure 6:
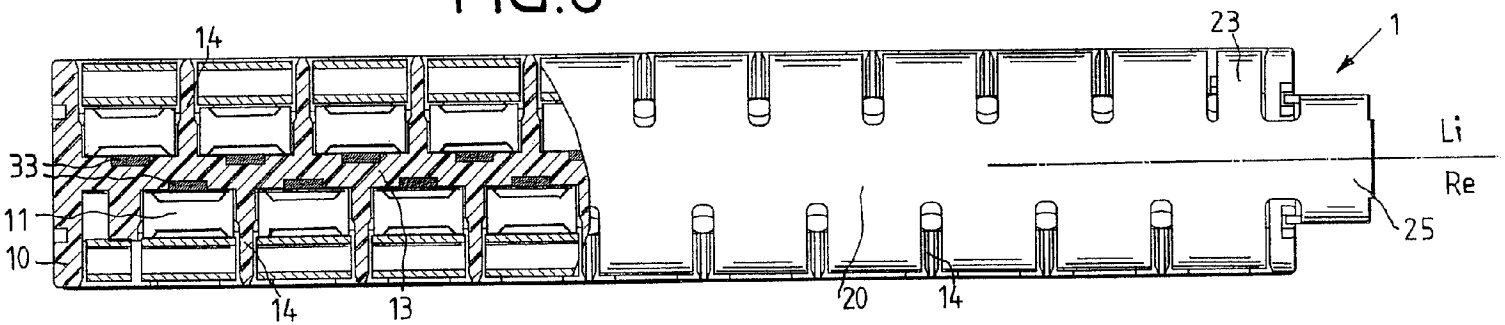
FIG. 6 shows a plan view of the overvoltage protection magazine, with the contact comb partially removed.
Figure 7:
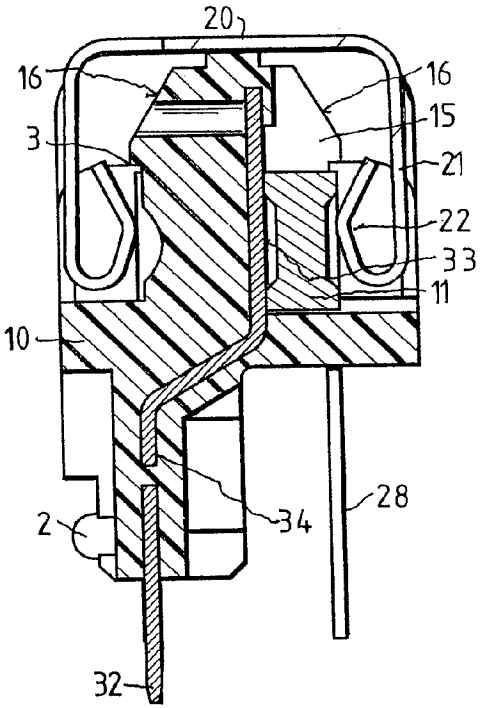
FIG. 7 shows a cross section through the overvoltage protection magazine.

FIG. 6 shows how the contact area 33 of the electrical contacts 34 is on the one hand embedded in plastic and on the other hand has one side which projects into the holder 12, in order to make contact there with the two-pole gas surge arrester 11, from one side. The other contact with the two-pole gas surge arrester 11 is made by means of the bend 22 of the sprung contact element 21, as illustrated in FIG. 7. This figure also shows that the incline 16, or the attachment or edge 3 adjacent to it projects beyond the two-pole gas surge arrester

11, so that the bend 22 does not strike the rim area 37 of the two-pole gas surge arrester 11, but rests directly on its bottom surface 36.

LIST OF REFERENCE SYMBOLS

1 Overvoltage protection magazine
2 Pin
3 Edge
10 Plastic housing
11 Two-pole gas surge arrester
12 Holders
13 Web
14 Separating walls
15 Sliding elements
16 Incline
17 Hole
18 Latching hook
19 Openings
20 Contact comb
21 Sprung contact elements
22 Bend
23 Locking lugs
24 Bend
25 Ground contact
27 Limb
28 Fork contacts
29 Hook
30 Contact grid
31 Lateral web
32 Insertion area
33 Contact area
34 Electrical contact
35 Groove
36 Bottom surface
37 Rim area
L Longitudinal direction
O Upper face
U Lower face
S End
Li Left-side
Re Right-side

The invention claimed is:

1. An overvoltage protection magazine comprising:
a plastic housing,
electrical contacts,
overvoltage protection elements and
at least one contact comb,
with the electrical contacts being arranged in the plastic housing and each having an insertion area and a contact area, with the electrical contacts being arranged in a row in the insertion area,
with the plastic housing having holders for the overvoltage protection elements which are arranged on both sides (left, right) along the longitudinal direction, with the contact areas of the electrical contacts projecting into the respective holder and producing a first electrical contact with the respective overvoltage protection element, and
with the contact comb having sprung contact elements in an area of the holders, which produce a second contact with the overvoltage protection element.

2. The overvoltage protection magazine as claimed in claim 1, wherein the contact comb is U-shaped and has sprung contact elements on each of its limbs.

3. The overvoltage protection magazine as claimed in claim 1, wherein the holders for the overvoltage protection elements are arranged offset with respect to one another on the two sides (left, right).

4. The overvoltage protection magazine as claimed in claim 1, wherein the sprung contact elements of the contact comb are in the form of cuts.

5. The overvoltage protection magazine as claimed in claim 1, wherein a ground contact is arranged at least one end of the contact comb.

6. The overvoltage protection magazine as claimed in claim 5, wherein the ground contact is in the form of a double fork contact.

7. The overvoltage protection magazine as claimed in claim 1, wherein the electrical contacts are in the form of contacts grids, which are stamped free through openings in the plastic housing.

8. The overvoltage protection magazine as claimed in claim 7, wherein the holders each have a circular cross section.

9. The overvoltage protection magazine as claimed in claim 8, wherein the holder is open to an upper face, with an opening angle being less than 180°.

10. The overvoltage protection magazine as claimed in claim 9, wherein the opening angle is less than 90°.

11. The overvoltage protection magazine as claimed in claim 1, wherein sliding elements, which are formed with an incline, are arranged above the holders.

12. The overvoltage protection magazine as claimed in claim 11, wherein one edge of the incline projects beyond the overvoltage protection elements.

13. The overvoltage protection magazine as claimed in claim 1, wherein the contact comb is formed with at least one locking lug.

14. The overvoltage protection magazine as claimed claim 5, wherein a hook is arranged above the ground contact and/or above a fork contact.

* * * * *

UNITED STATES PATENT AND TRADEMARK OFFICE

CERTIFICATE OF CORRECTION

PATENT NO. : 7,901,255 B2
APPLICATION NO. : 12/526923
DATED : March 8, 2011
INVENTOR(S) : Neumetzler et al.

It is certified that error appears in the above-identified patent and that said Letters Patent is hereby corrected as shown below:

On the Title Pg, Item (22) PCT Filed: "Feb. 13, 2007" should read --Dec. 13, 2007--

Col. 2, line 21: "arranged at least one of the" should read --arranged at at least one end of the--

Col. 6, line 21, claim 5: "arranged at least one end" should read --arranged at at least one end--

Signed and Sealed this
Sixth Day of March, 2012

David J. Kappos

David J. Kappos
*Director of the United States Patent and Trademark Office*